US005950573A

United States Patent [19]

Shellenberger et al.

[11] Patent Number: 5,950,573

[45] Date of Patent: Sep. 14, 1999

[54] POWER VENTED WATER HEATER WITH AIR INLET

[75] Inventors: Timothy J. Shellenberger, Johnson City; Fred A. Overbey, Jr., Bristol, both of Tenn.

[73] Assignee: SRP 687 Pty. Ltd., Australia

[21] Appl. No.: 09/174,153

[22] Filed: Oct. 16, 1998

[51] Int. Cl.[6] ..... F22B 37/47

[52] U.S. Cl. ..... 122/448.1; 122/13; 122/17

[58] Field of Search ..... 122/13, 17, 448.1; 126/351, 374

[56] References Cited

U.S. PATENT DOCUMENTS

| | | |
|---|---|---|
| 736,153 | 8/1903 | Reynolds . |
| 1,806,216 | 5/1931 | Plummer . |
| 1,841,463 | 1/1932 | Barber et al. . |
| 2,479,042 | 8/1949 | Gaines . |
| 3,161,227 | 12/1964 | Goss et al. . |
| 3,947,229 | 3/1976 | Richter . |
| 4,039,272 | 8/1977 | Elliott . |
| 4,177,168 | 12/1979 | Denny et al. . |
| 4,241,723 | 12/1980 | Kitchen . |
| 4,510,890 | 4/1985 | Cowan . |
| 4,519,770 | 5/1985 | Kesselring et al. . |
| 4,639,213 | 1/1987 | Simpson . |
| 4,823,770 | 4/1989 | Loeffler . |
| 4,863,370 | 9/1989 | Yokoyama et al. . |
| 4,869,232 | 9/1989 | Narang . |
| 4,893,609 | 1/1990 | Girodani et al. . |
| 4,919,085 | 4/1990 | Ishiguro . |
| 4,924,816 | 5/1990 | Moore, Jr. et al. . |
| 4,960,078 | 10/1990 | Yokoyama et al. . |
| 5,044,928 | 9/1991 | Yokoyama et al. . |
| 5,085,205 | 2/1992 | Hall et al. . |
| 5,205,731 | 4/1993 | Reuther et al. . |
| 5,215,457 | 6/1993 | Sebastiani . |
| 5,240,411 | 8/1993 | Abalos . |
| 5,246,397 | 9/1993 | Petter . |
| 5,317,992 | 6/1994 | Joyce . |
| 5,355,841 | 10/1994 | Moore, Jr. et al. . |
| 5,368,263 | 11/1994 | Harrison . |
| 5,385,467 | 1/1995 | Sebastiani et al. . |
| 5,427,525 | 6/1995 | Shukla et al. . |
| 5,435,716 | 7/1995 | Joyce . |
| 5,448,969 | 9/1995 | Stuart et al. . |
| 5,494,003 | 2/1996 | Bartz . |
| 5,520,536 | 5/1996 | Rodgers et al. . |
| 5,522,723 | 6/1996 | Durst et al. . |
| 5,588,822 | 12/1996 | Hayakawa . |
| 5,649,821 | 7/1997 | Fogliani et al. . |
| 5,791,298 | 8/1998 | Rodgers . |
| 5,797,355 | 8/1998 | Bourke et al. . |
| 5,797,358 | 8/1998 | Brandt et al. . |

FOREIGN PATENT DOCUMENTS

| | | |
|---|---|---|
| 0 560 419 A2 | 9/1993 | European Pat. Off. . |
| 0 596 555 A1 | 5/1994 | European Pat. Off. . |
| 0 657 691 A1 | 6/1995 | European Pat. Off. . |
| 25 40 709 A1 | 3/1977 | Germany . |
| 39 26 699 A1 | 2/1991 | Germany . |
| 60-134117 | 7/1985 | Japan . |
| 62-162814 | 7/1987 | Japan . |
| WO 94/01722 | 1/1994 | WIPO . |

OTHER PUBLICATIONS

"Flame Traps—a Technical Note" Journal of Mines, Metals & Fuels, Jul. 1987.

*Primary Examiner*—Teresa Walberg
*Assistant Examiner*—Gregory A. Wilson
*Attorney, Agent, or Firm*—T. Daniel Christenbury

[57] ABSTRACT

A water heater comprising a water container; a combustion chamber adjacent the water container; a burner associated with the combustion chamber; a flue connected to the combustion chamber; a blower assembly positioned to receive combustion products from the flue and including a blower; at least one inlet having a plurality of ports which permit air and extraneous fumes to enter the combustion chamber and prevent combustion of extraneous fumes outside of the combustion chamber; a temperature sensor positioned adjacent the inlet; and a controller connected to the blower and the temperature sensor, the controller being capable of activating the blower in response to temperature changes detected by the temperature sensor.

24 Claims, 10 Drawing Sheets

10
55
52
54
50
42
48
18
46
38
12
72
14
74
44
40
32
75
41
30
28
16
36
45
20
22
87
26
24
23
79
23

POWER VENTED WATER HEATER WITH AIR INLET

FIELD OF INVENTION

This invention relates to power vented water heaters, particularly to improvements to gas fired power vented water heaters adapted to render them safer and more efficient.

BACKGROUND OF INVENTION

Typical gas-fired water heaters are constructed for installation and operation in indoor spaces such as basements, garages, laundryrooms, closets and the like. Many such constructions do not have a chimney available for use as a means to exhaust flue gases or products of combustion from the water heater. Accordingly, other flue exhaust systems have been developed which exhaust flue gases from the building in an alternate manner. Representative examples include the water heaters disclosed in U.S. Pat. Nos. 4,672,919 and 5,255,665.

Since such water heaters do not utilize the natural draft afforded by a chimney, such water heaters are equipped with fans or blowers to assist the flue gases or combustion products from the upper portion of the water heater outwardly of the building. The presence of the fans or blowers presents the potential for flue gases to exhaust into the interior space if the fan or blower is not working properly or if there is blockage of the conduit extending from the fan or blower to the exterior of the building. Thus, various measures have been taken to help increase the safety factor in the operation of such water heaters.

Another difficulty with many locations for water heaters is that the locations are also used for storage of other equipment such as lawn mowers, trimmers, snow blowers and the like. It is a common procedure for such machinery to be refueled in such locations.

There have been a number of reported instances of spilled gasoline and associated extraneous fumes being accidently ignited. There are many available ignition sources, such as refrigerators, running engines, electric motors, electric and gas dryers, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes," "extraneous fumes species," "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

It has been reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The invention aims to substantially raise the probability of successful confinement of ignition of spilled flammable substances from typical spillage situations to the inside of the combustion chamber.

SUMMARY OF THE INVENTION

The invention relates to a power vented water heater including a water container and a combustion chamber adjacent the container. The combustion chamber has at least one inlet to admit air and extraneous fumes into the combustion chamber and an outlet to vent combustion products. A blower assembly is positioned to receive the combustion products from the outlet and convey them to a remote location. The inlet has a plurality of ports which permit air and extraneous fumes to enter the combustion chamber and prevent combustion of extraneous fumes outside of the combustion chamber. The water heater also includes a burner associated with the combustion chamber and arranged to combust fuel to heat water in the container.

DETAILED DESCRIPTION OF THE INVENTION

Figure 1:
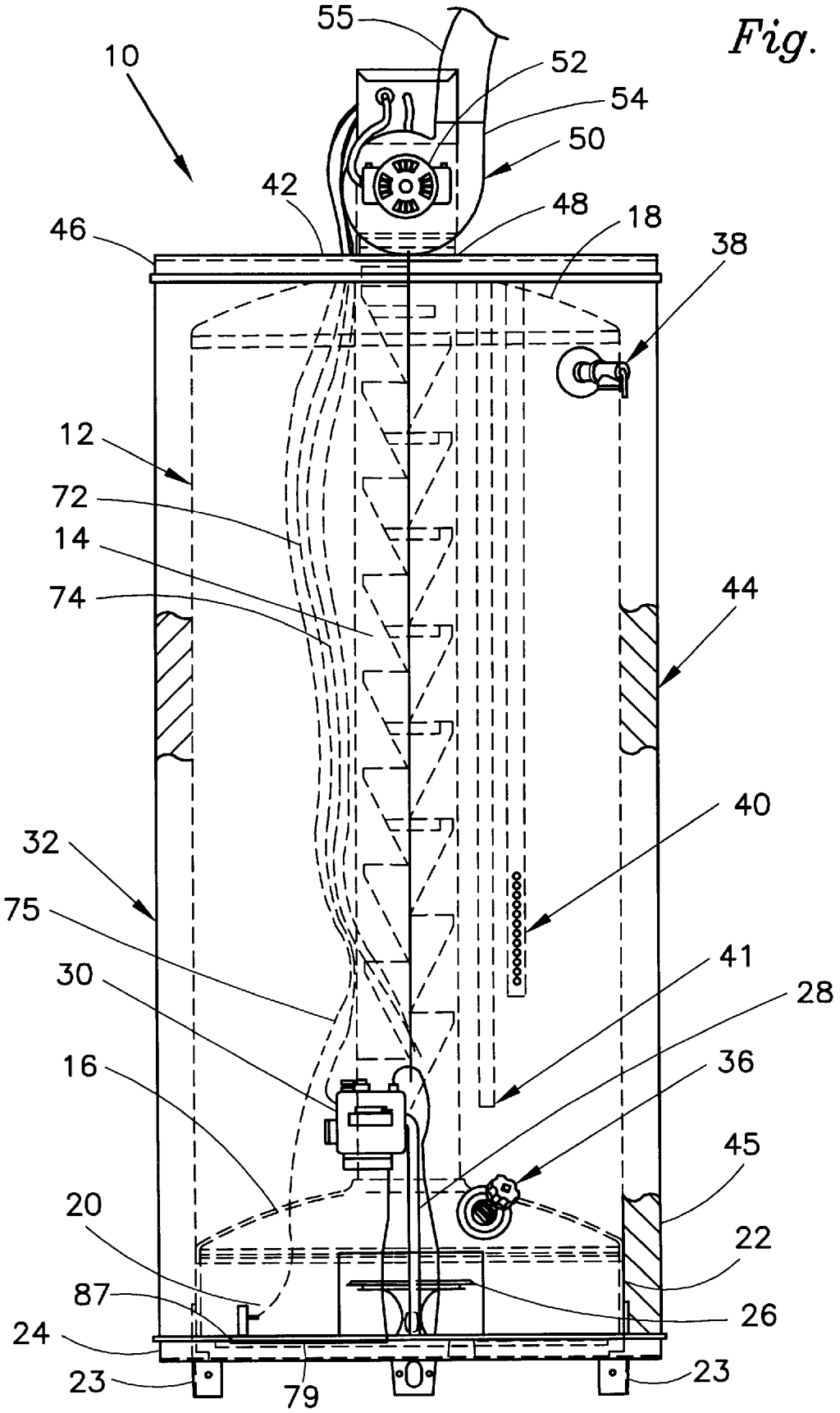
FIG. 1 shows a front elevational view, partly taken in section, of a water heater in accordance with aspects of the invention, the dash lines indicating interior components.

It will be appreciated that the following description is intended to refer to the specific embodiments of the invention selected for illustration in the drawings and is not intended to define or limit the invention, other than in the appended claims.

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

Power vented gas water heaters are similar to natural draft water heaters in several ways. Burners, gas control valves, combustion chamber, tank/flue tube construction, and baffles are often similar if not equivalent between these two designs. The primary difference is in the way the products of combustion are vented to the atmosphere. Power vented gas water heaters utilize a draft inducer or blower to draw in combustion air to the burner and to draw in dilution air to cool the combustion gases. The temperature of these combustion gases is such that they can be vented with plastic piping such as ABS, PVC, CPVC and the like.

Because blower operation is required for the proper and safe operation of this design, a specialized sequence of operation is used. This sequence of operation can be performed by either electromechanical or electronic control circuitry and with a standing pilot or an electronic ignition system.

The typical electromechanical, standing pilot approach often follows the sequence below although other sequences may be employed:

1. The thermostat calls for heat.
2. Fuel gas flows from the gas valve to a gas pressure switch. Fuel gas flow to the burner is prevented by means of a closed solenoid valve.
3. A pressure switch activates a relay which in turn activates the blower.
4. Vacuum produced by the blower activates a negative pressure switch which in turn activates the solenoid valve.
5. Fuel gas flows to the burner and is ignited by the pilot.
6. Satisfaction of the thermostat reduces fuel gas flow from the gas valve, deactivates the gas pressure switch, and deactivates the blower.

An electronic control, standing pilot system approach such as that embodied in co-pending application Ser. No. 09/090,638, filed Jun. 4, 1998, the disclosure of which is incorporated herein by reference, is fundamentally as follows:

1. The thermostat calls for heat.
2. The blower energizes.
3. The pressure switch terminals close.
4. The pressure switch energizes the gas valve.
5. The call for heat is satisfied.
6. The blower deactivates, pressure switch terminals open, and gas valve deactivates.

Additional circuitry can be incorporated into both the electromechanical and electronic control approach. One example is to incorporate circuitry adapted to allow for the addition of hot surface igniters or spark ignition devices to light the burner.

Conventional water heaters, both natural draft and power vented, typically have their source(s) of ignition at or near floor level. In the course of attempting to develop water heater combustion chambers for natural draft water heaters, it has been discovered that a type of air inlet constructed by forming ports in sheet-like materials in particular ways have particular advantages in damage resistance when located at the bottom of a heavy appliance such as a water heater which generally stands on a floor. It has further been discovered that providing ports having well defined and in controlled geometries assists reliability of the air intake and flame confining functions in a wide variety of circumstances.

A thin sheet metallic plate having many ports of closely specified size formed, cut, punched, perforated, etched, punctured and/or deformed through it at a specific spacing is especially preferred because it provides an excellent balance of performance, reliability and ease of accurate manufacture. In addition, the plate provides damage resistance prior to sale and delivery of a fuel burning appliance such as a water heater having such an air intake and during any subsequent installation of the appliance in a user's premises.

On the other hand, both ceramic plaque tiles (such as SCHWANK tiles) and woven metal mesh, for example, have proven quite successful in confining combustion under a variety of circumstances.

The dynamics typically observed in natural draft water heaters having an air inlet of the type described above are changed dramatically in power vented water heaters because of the negative pressure created by the blower assembly. In the event that extraneous fumes enter the combustion chamber while the blower is operating, vapors burning on the air inlet can cause flue temperatures to exceed the operational temperatures of the vent pipe, which is typically plastic, because of the additional thermal input. Melting or distortion of this piping can result in vent pipe restriction or potential leakage of products of combustion into the home. This same problem can also occur when the blower is deactivated and no dilution air is drawn into the collection box to cool the flue gases.

The invention addresses ways of overcoming such problems. We have discovered a solution to this problem by insuring that the blower is activated when extraneous fumes or vapors enter the combustion chamber and are burning on the air inlet.

Figure 2:
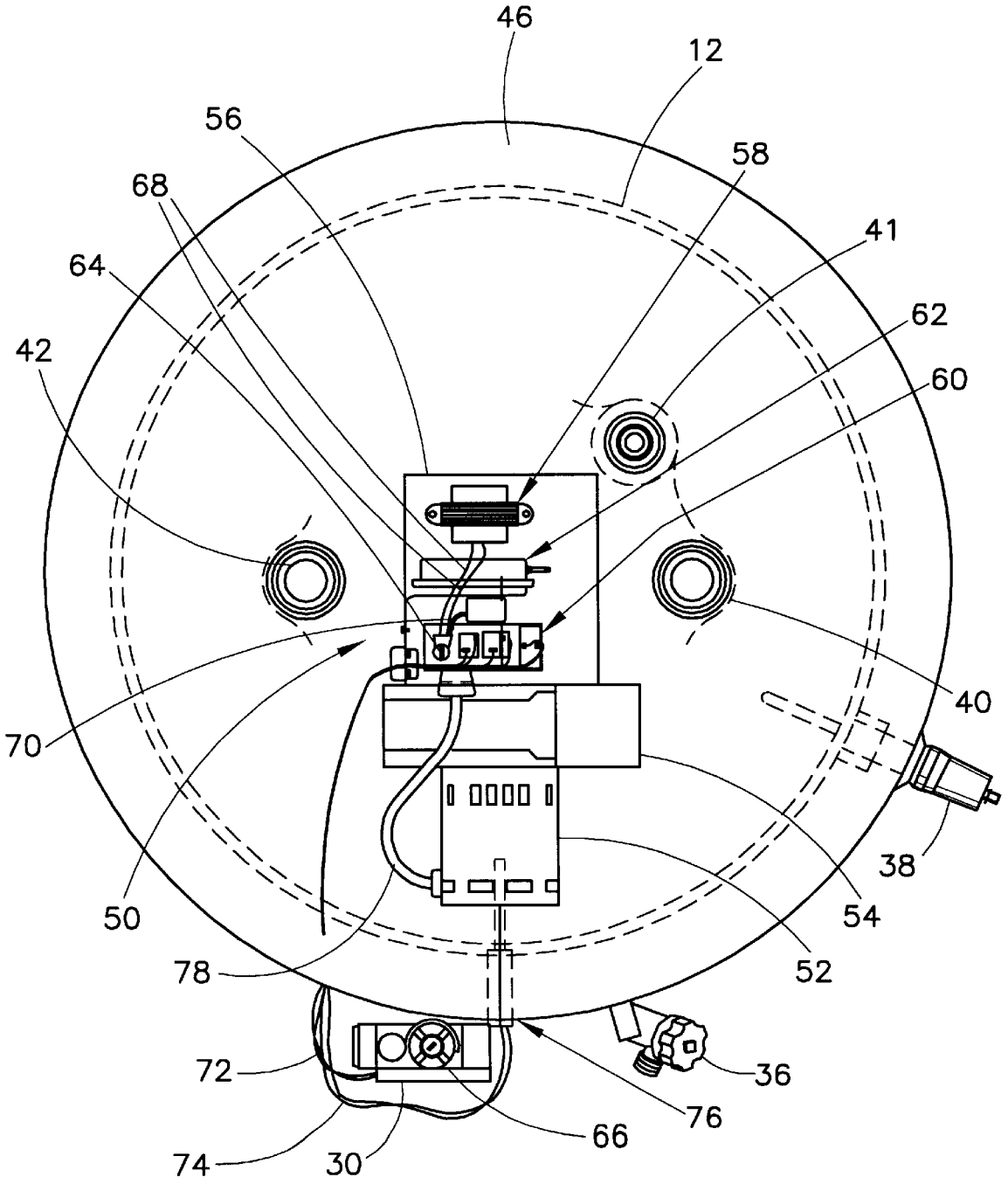
FIG. 2 shows a top plan view of the water heater of FIG. 1.

Turning now to the drawings in general and FIGS. 1 and 2 in particular, the number "10" designates a gas-fired water heater of the invention. Water heater 10 is formed from a water tank 12 having a flue 14 extending between tank bottom 16 and tank head 18. A combustion chamber 20 is located beneath tank bottom 16 and formed from sidewall 22, bottom pan 24 and tank bottom 16. A gas-fired burner 26 is located within combustion chamber 20 and connects to a fuel line 28 which connects to a fuel valve 30. Fuel valve 30 is mounted onto jacket 32 and connects to a sensor 76.

A top pan 46 connects to the upper portion of jacket 32 and contains opening 48 through which flue 14 extends. A water inlet 40 and anode 41 extend into a lower portion of tank 12 through top pan 46. Similarly, a water outlet 42 extends into an upper portion of tank 12 and outwardly of top pan 46. Foam insulation 44 is located between jacket 32 and tank 12, and between top pan 46 and tank head 18. Fiberglass insulation 45 surrounds combustion chamber 20 and is also located between tank 12 and jacket 32. A drain valve 36 connects into a lower portion of tank 12 and extends outwardly through jacket 32. Similarly, a T&P valve 38 connects to an upper portion of tank 12 and extends outwardly through jacket 32.

Water heater 10 is mounted preferably on legs 23 to raise the bottom pan 24 of the combustion chamber 20 off the floor. In bottom pan 24 is an aperture 87 which is closed gas tightly by an air inlet 79 which admits air for the combustion of the fuel gas combusted through main burner 26 and the pilot burner, regardless of the relative proportions of primary and secondary combustion air used by each burner.

Where bottom pan 24 meets the vertical walls of combustion chamber 20, adjoining surfaces can be either one piece or alternatively sealed thoroughly to prevent ingress of air or flammable extraneous fumes. Gas, water, electrical, control or other connections, fittings or plumbing, wherever they pass through the side wall combustion chamber are substantially sealed. The combustion chamber 20 is substantially air/gas tight except for means to supply combustion air and to exhaust combustion products through flue 14. Pilot flame establishment can be achieved by a piezoelectric igniter. A pilot flame observation window can be provided which is substantially sealed.

A blower assembly 50 is positioned on top pan 46 and over opening 48 to receive flue gases or combustion products from flue 14. Blower assembly 50 includes an electric motor 52 which powers blower 54 and an exhaust conduit 55. A flue gas collection box 56 connects to blower 54 and is directly positioned over opening 48. A transformer 58, electronic controller 60 and pressure switch 62 are positioned above flue gas collection box 56. Electronic controller 60 is equipped with a temperature adjuster 64. Similarly, fuel valve 30 is equipped with a on-off-pilot switch 66.

As shown in FIGS. 1–4, wires 68 connect between transformer 58 and electronic controller 60. Similarly, wires 70 connect between pressure switch 62 and controller 60. Wires 72 connect between electronic controller 60 and fuel valve 30. Wires 74 also connect between electronic controller 60 and thermistor 76 (a bimetal switch may be substituted). Power cord 78 connects between electric motor 52 and electronic controller 60.

Figure 3:
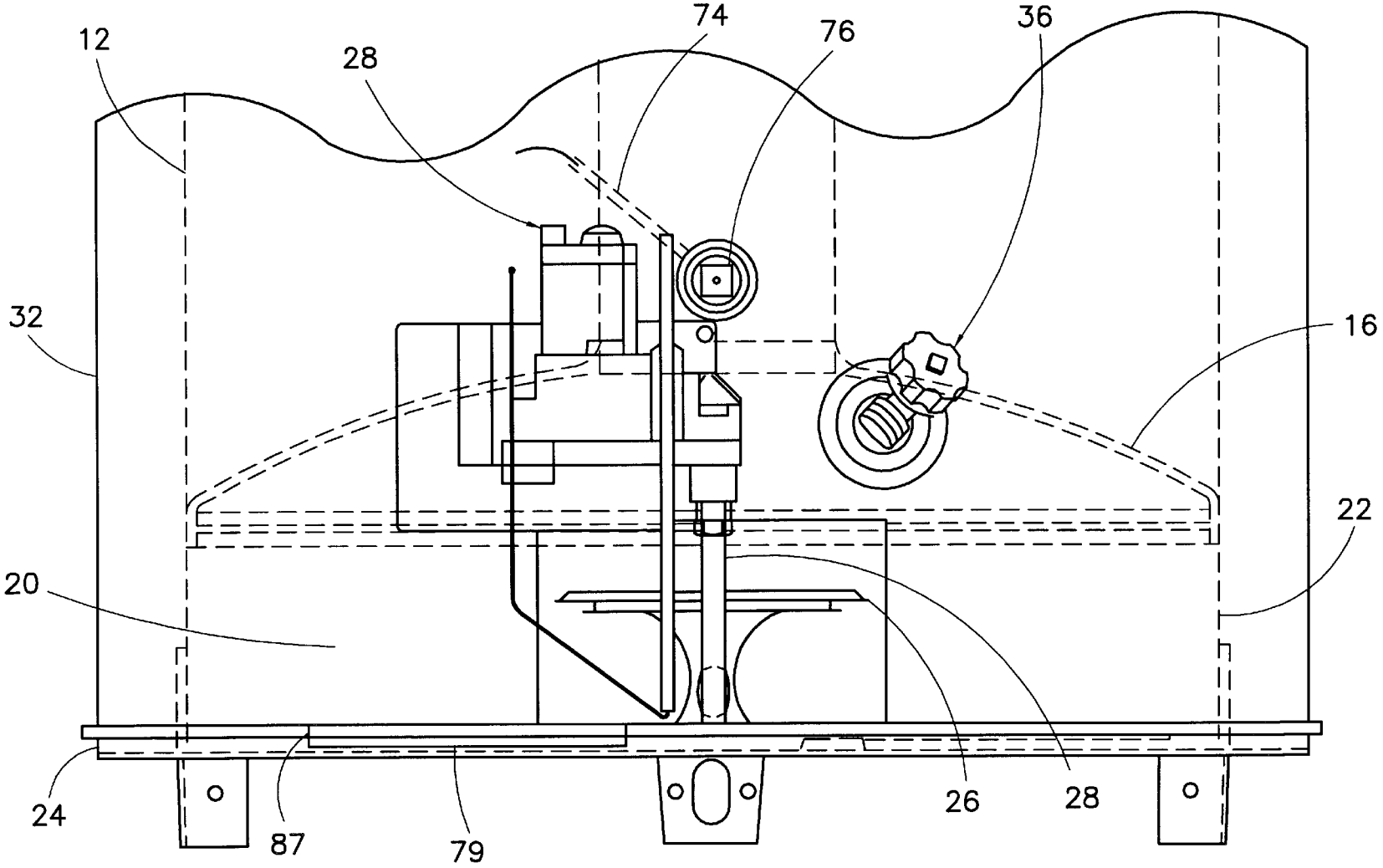
FIG. 3 shows an exploded front elevational view of the lower portion of the water heater shown of FIG. 1.
Figure 4:
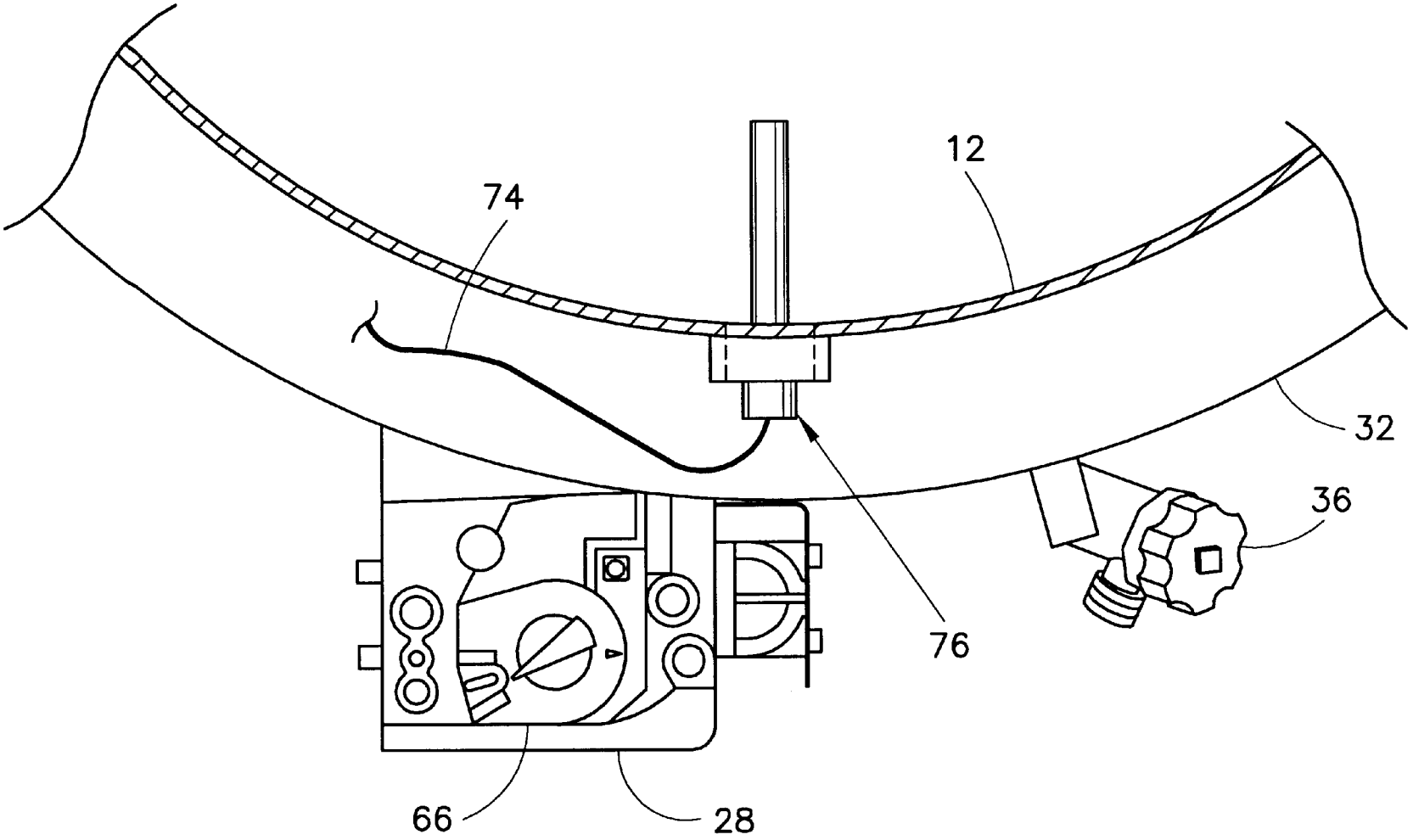
FIG. 4 shows a portion of the front of a water heater shown from above, with emphasis on the placement of the water temperature sensor on the water heater water tank.

FIGS. 3 and 4 show exploded views of the positioning of thermistor 76 in relation to fuel valve 30 from the side and the top, respectively. Thermistor 76 is preferably located near the bottom portion of tank 12, and is elevated just above tank bottom 16. Thermistor 76 is inserted through the wall of tank 12 and extends inwardly into tank 12 to sense the temperature of the water.

Figure 5:
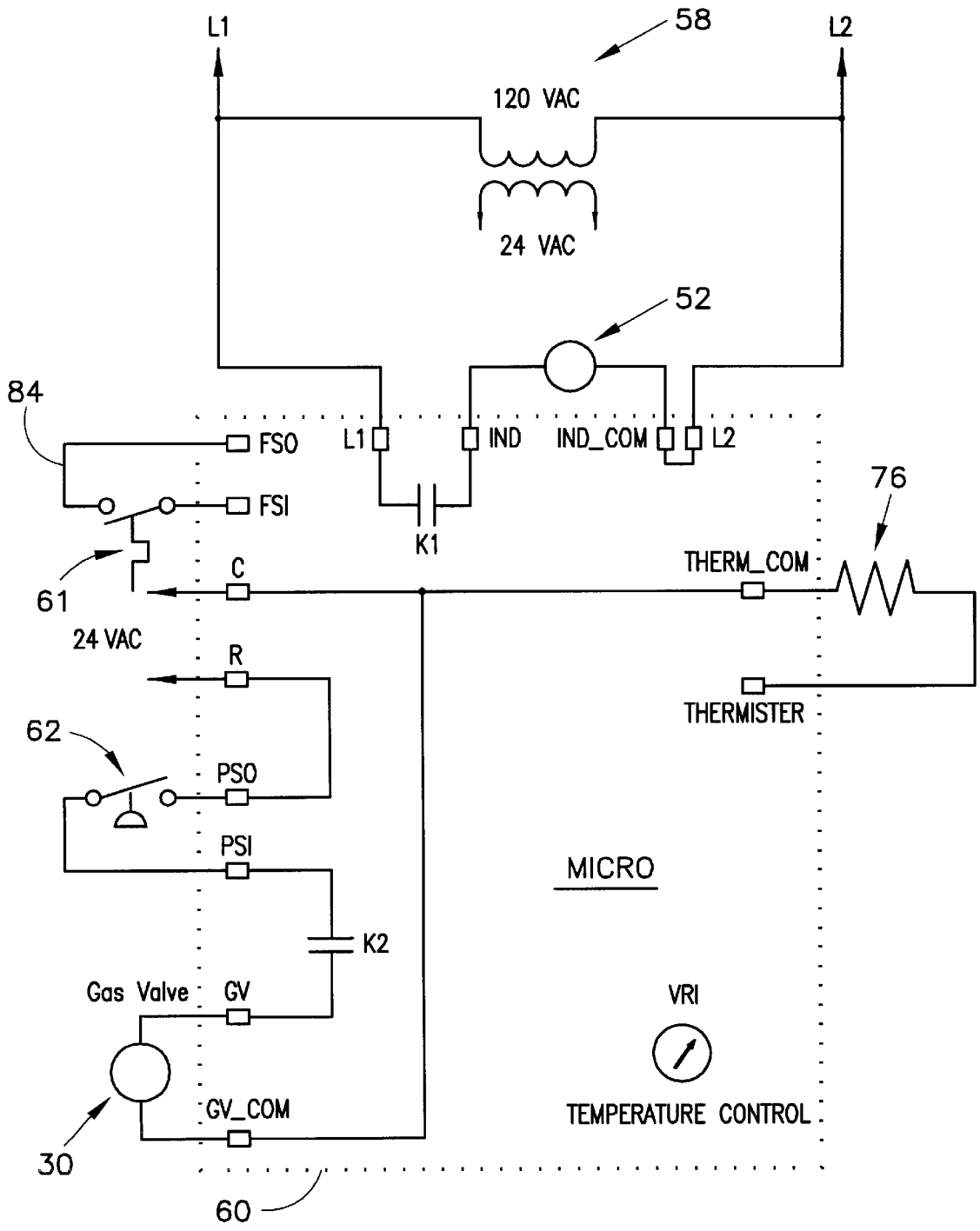
FIG. 5 is an electrical schematic of the normal operation portion of a preferred control system of a water heater in accordance with aspects of the invention.
Figure 6:
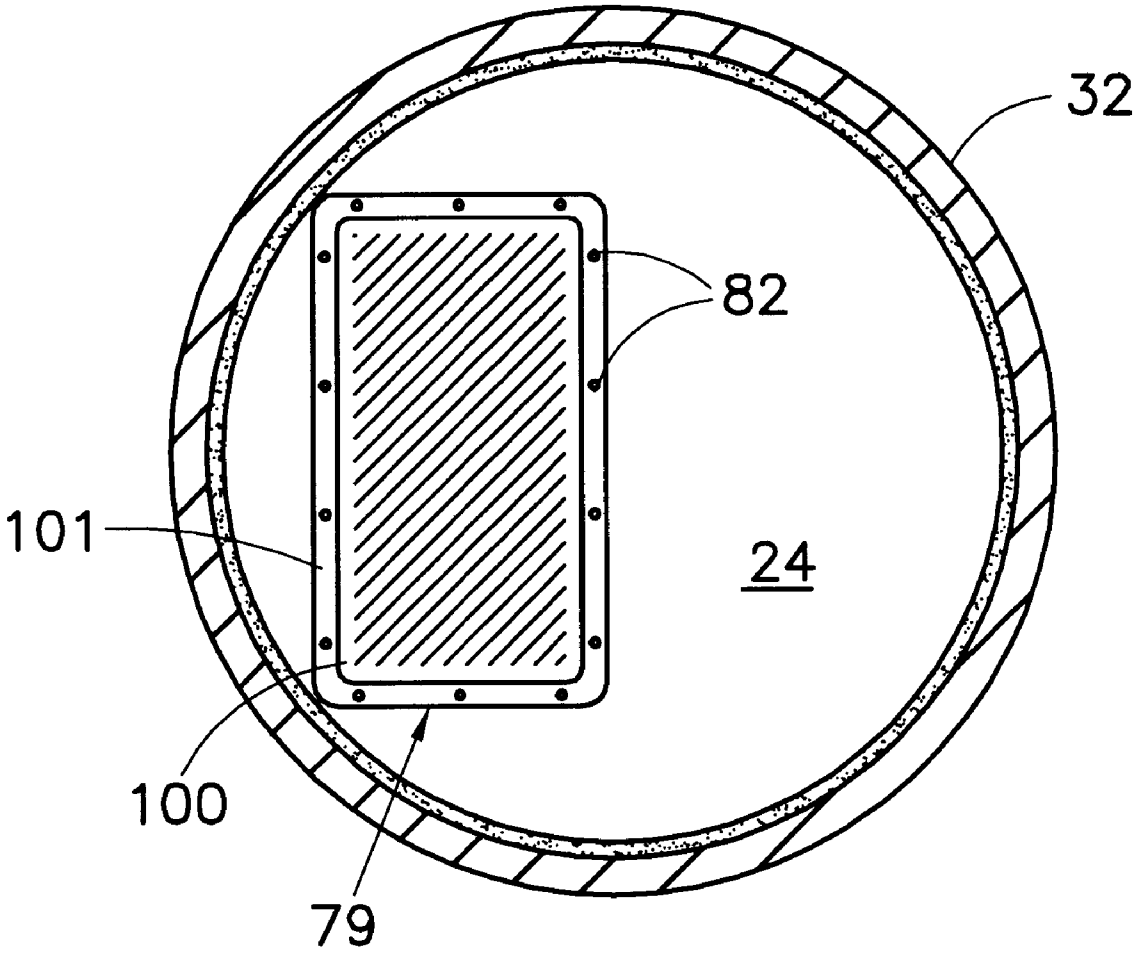
FIG. 6 is a cross-sectional view of a water heater of the type shown in FIG. 1, with portions removed, to show the relative position of an air inlet mechanically crimped to the water heater bottom pan.

FIG. 5 is a schematic showing the normal operation portion of a preferred configuration of controller 60. Controller 60 preferably incorporates electronic control circuitry for controlling operation of the water heater, as described in more detail below. Such control circuitry may incorporate a number of electronic components, well known to those of ordinary skill in the art, such as solid state transistors and accompanying biasing components, or one or more equivalent programmable logic chips. The electronic control circuitry may also incorporate a programmable read only memory (PROM), random access memory (RAM) and a microprocessor.

The arrangement and/or programming of these components may take any number of forms well known to those of ordinary skill in the art to accomplish operation of the water heater. As shown in FIG. 5, power is supplied to controller 60 and to electric motor 52 through transformer 58. Power may be supplied to transformer 58 from household current, which is typically 120 VAC. Transformer 58 preferably reduces the voltage supplied to controller 60 to 24 VAC. Electrical power is supplied to transformer 58 at points L1 and L2 and to controller 60 itself at points R and C. Additional components may also be used in supplying power to controller 60 from transformer 58, such as resistive elements to prevent overheating of the controller from a large current draw, and/or one or more blocking capacitors. Such elements are, of course, well known to those of ordinary skill in the art.

Pressure switch 62 is connected to controller 60 at points PS0 and PS1. Gas valve 30 is connected to controller 60 at points GV and GV COM. Electric motor 52 is connected to controller 60 at points IND and IND COM. Thermistor 76 is also connected as shown. A bimetal switch may also be substituted for thermistor 76. Additional circuitry may also be included, such as capacitive elements, K1 and K2, well known to those in the art.

Figure 7:
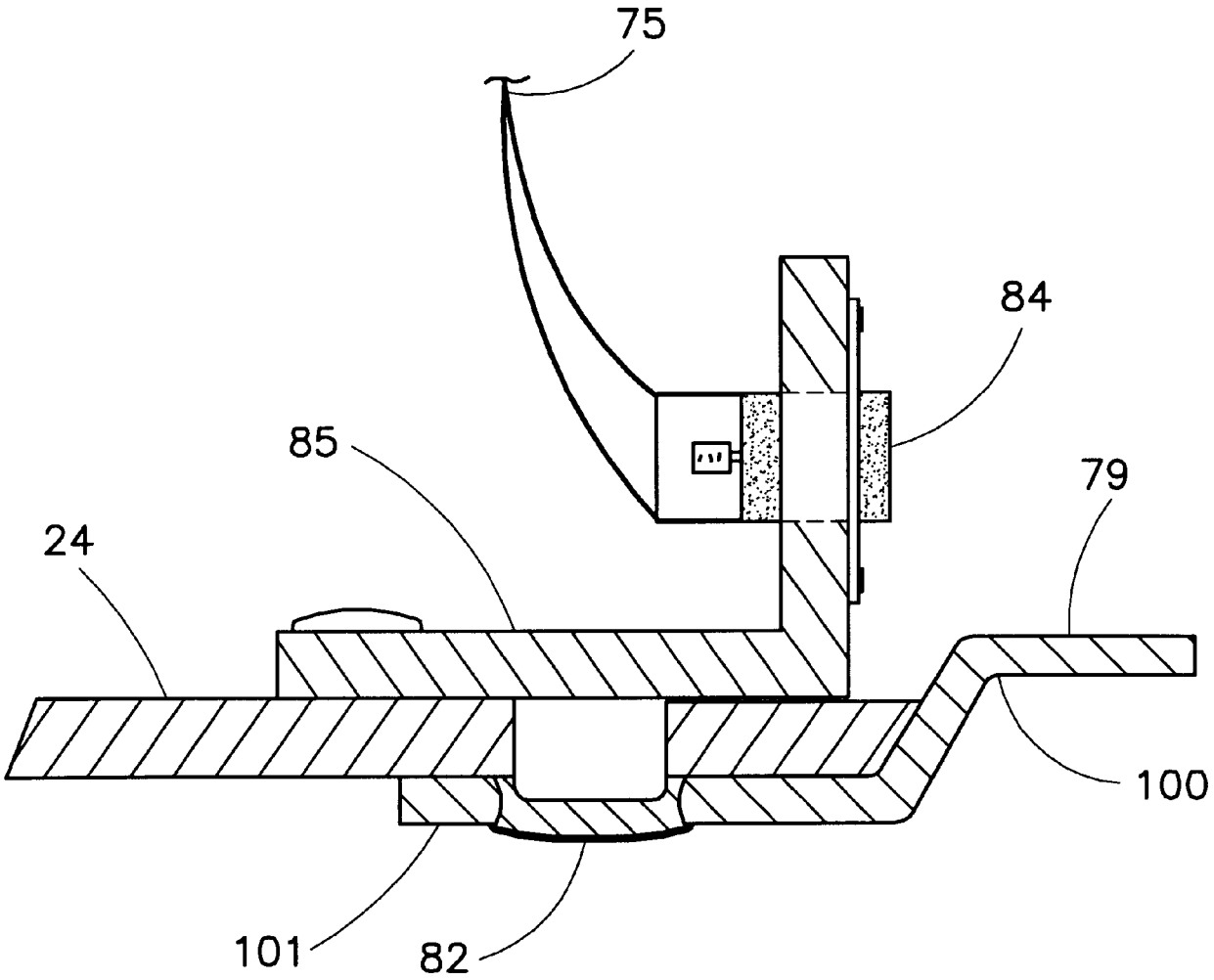
FIG. 7 is an exploded view of a mechanical crimp shown in FIG. 6 and an electromechanical switch.

Temperature sensor 84, which is a bimetal switch in FIG. 7, connects to controller 60 at points FS0 and FS1. Electric motor 52 is actuated when the switch 61 associated with sensor 84 is open and deactuated when switch 61 is closed.

The physical implementation of these connections is shown in FIG. 2, along with the inclusion of temperature adjuster 64 for setting water temperature set points. Temperature adjuster 64 is preferably a rotary dial attached to a variable resistor or potentiometer, and is connected in a conventional manner to the circuitry of controller 60.

Temperature adjuster 64 is used in connection with the circuitry of controller 60 to control operation of the water heater of the invention, as described below in connection with the drawings.

Withdrawal of hot water from water outlet 42 results in simultaneous introduction of cold water into tank 12 through water inlet 40. Thermistor 76 detects temperature changes and feeds temperature information to controller 60. Controller 60 checks pressure switch 62 to determine whether or not the pressure switch contacts are open. If pressure switch 62 is in an open condition, controller 60 provides an output to energize electric motor 52, thereby causing blower 54 to actuate and draw air into collection box 56 from flue 14 through opening 48. Controller 60 continues to monitor pressure switch 62 until the pressure switch contacts close. If air is not flowing from flue 14 and/or exhaust line 55 because of blockage, the pressure switch contacts remain open, thereby preventing initiation of a prepurge cycle and the energizing of fuel valve 30.

Once the pressure switch contacts close, controller 60 initiates a prepurge cycle, preferably the prepurge being about eight seconds, after pressure switch 62 closes. Controller 60 then provides an output to fuel valve 30 to energize it so that fuel can be supplied through fuel line 28 to burner 26. Simultaneously, thermistor 76 continues to monitor the temperature of water within tank 12. When thermistor 76 sends temperature information to controller 60 that matches the preset water temperature, controller 60 provides an output to fuel valve 30 and electric motor 52 for them to deenergize.

The water temperature set points are variably adjustable and are preferably about 90–180° F.

Controller 60 preferably includes a lock-out system that is initiated when the water temperature within tank 12 reaches a predetermined temperature, preferably less than or equal to about 210° F. This is known as over-temperature condition. This temperature is determined by an input signal received from thermistor 76. Upon receiving such an input, controller 60 provides an output which deenergizes all electrical components. The system lock-out can only be reset by removing power, preferably for more than one second, and then reapplying power to the water heater unit.

Controller 60 may also be adapted to be compatible with a relay board used in an air handler for a combination water heating/air heating system. The relay board (not shown) of such a system provides outputs for the blower motor (heat and cool speeds), water circulating pump, electronic air cleaner and humidifier. The input function to the relay board would be from the conventional room thermostat. Controller 60 in such a case can receive temperature information from the relay board and shut down or terminate the supply of hot water to the air heating system when the received temperature information exceeds a predetermined level.

FIGS. 6–10 show a preferred arrangement of air inlet 79 with respect to bottom pan 24 and the manner in which air inlet 79 is fixed or sealed to that bottom pan 24. Air inlet 79 is sealed to combustion chamber 20 at an aperture in bottom pan 24 of the combustion chamber and preferably comprises a thin sheet metal air inlet 79 having a perforated area 100 and an unperforated border or flange 101. Holes 104 in the perforated area 100 of air inlet 79 can be circular or other shape although slotted holes have certain advantages.

It is intended that air inlet 79 be substantially sealed against bottom pan 24 to prevent air and/or extraneous fumes to pass between facing surfaces of air inlet 79 and bottom pan 24. Outer flange 101 extends beyond the edge of the opening in bottom pan 24. Periodically, along flange 101, mechanical crimps 82 are "pressed" into flange 101 and the corresponding portion of bottom pan 24. Such crimps 82 are well known in the sheet metal fabrication art, TOG-L-LOC® crimps being a particularly preferred example. Other means of securing or fixing air inlet 79 to bottom pan 24 are possible, spot welding being one example, heat resistant adhesive being another.

Air inlet 79 also preferably has a raised portion that extends above the upper surface of bottom pan 24. This is specifically shown in FIG. 7 and assists in ensuring that condensation generated in flue 14 does not lie or congregate on air inlet 79 so as to occlude the openings/slots 104 therein. A temperature sensor 84 is positioned adjacent air inlet 79 on a bracket 85 that is secured by any suitable means to bottom pan 24. Temperature sensor 84 may be an electromechanical sensor, such as a bimetallic switch as shown or an electronic sensor such as a thermistor or thermocouple, or any temperature sensing device capable of operating in accordance with the present invention. Sensor 84 is positioned to detect the presence of flames at or near the surface of air inlet 79 and connects to controller 60 by wires 75 (see FIG. 1 also).

Figure 8:
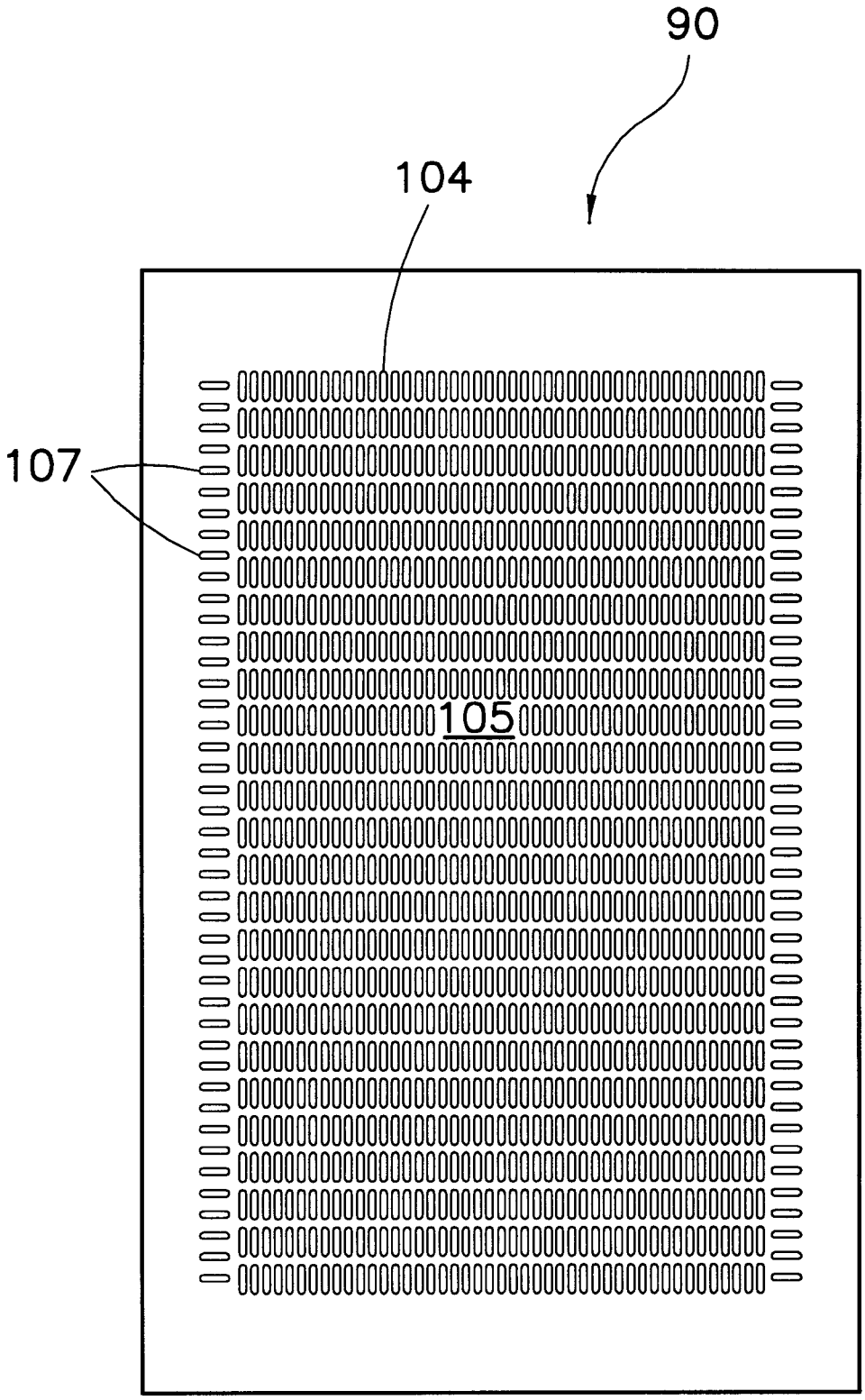
FIG. 8 shows a top plan view of a preferred air inlet of the invention.

FIG. 8 shows an especially preferred air inlet 79 as will be described to admit air to combustion chamber 20. The air inlet 79 is a thin sheet metal plate having many small slots 104 passing through it. The metal may be stainless steel having a nominal thickness of about 0.5 mm although other metals such as copper, brass, mild steel and aluminum and thicknesses in the range of about 0.3 mm to about 1 mm, are suitable. Depending on the metal and its mechanical properties, the thickness can be adjusted within the suggested range. Grade 309, 316 or 430 stainless steel, having a thickness of 0.45 mm to 0.55 mm are preferred for blanked or photochemically machined plates 90.

Slots 104 have their longitudinal axes parallel except for the edge slots 107 at right angles to those of the ports 104 in the remaining perforated area 105. The ports are arranged in a rectangular pattern formed by the aligned rows. The plate is most preferably about 0.5 millimeters thick. This provides air inlet 79 with adequate damage resistance and, in all other aspects, operates effectively. The total cross-sectional area of the slots 104 is selected on the basis of the flow rate of air required to pass through the air inlet during normal and overload combustion. For example, a gas fired water heater rated at 50,000 BTU/hour requires at least about 3,500 to 4,000 square millimeters of port space in plates of nominal thickness 0.5 mm.

Slots 104 are provided to allow sufficient combustion air through the air inlet 79 and there is no exact restriction on the total number of slots 104 or total area of the inlet, both of which are determined by the capacity of a chosen burner to generate heat by combustion of a suitable quantity of fuel with the required quantity of air to ensure complete combustion in the combustion chamber and the size and spacing of the slots 104. The air for combustion passes through the slots and not through any larger inlet air passage or passages to the combustion chamber. No such larger inlet is provided.

Figure 9:
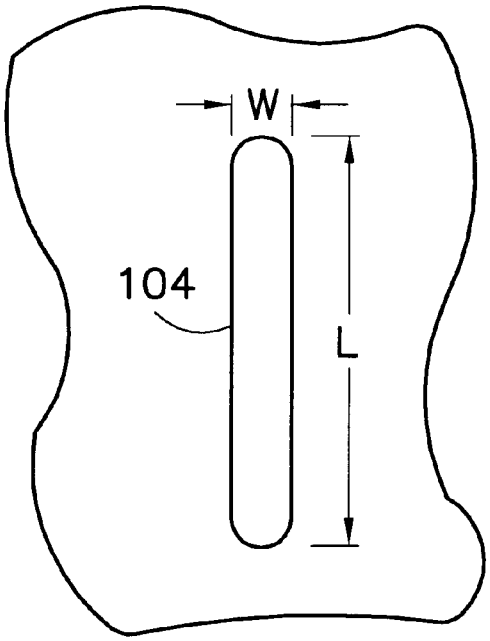
FIG. 9 illustrates a plan view of a single port taken from the air inlet shown in FIG. 8.

FIG. 9 shows a single slot 104 having a length L, width W and curved ends. To confine any incident of the above-mentioned accidental dangerous ignition inside the combustion chamber 20, the slots 104 are formed having at least about twice the length L as the width W and are preferably at least about twelve times as long. Length to width (L/W) ratios outside these limits are also effective. Slots are more effective in controlling accidental deflagration or detonation ignition than circular holes, although beneficial effect can be observed with L/W ratios in slots as low as about 3. Above L/W ratios of about 15 there can be a disadvantage in that in an air inlet of thin flexible metal possible distortion of one or more slots 104 may be possible as would tend to allow opening at the center of the slots creating a loss of dimensional control of the width W. However, if temperature and distortion can be controlled then longer slots can be useful; reinforcement of a thin inlet plate by some form of stiffening, such as cross-breaking, can assist adoption of greater L/W ratios. L/W ratios greater than about 15 are otherwise useful to maximize air flow rates and use of a thicker plate material than about 0.5 mm or a more highly tempered grade of steel, stainless steel or other chosen metal, favors a choice of a ratio of about 20 to 30.

To perform their ignition confinement function, it is important that the slots 104 perform in respect of any species of extraneous flammable fumes which may reasonably be expected to be involved in a possible spillage external to the combustion chamber 20 of which the air inlet of the invention forms an integral part or an appendage.

Figure 10:
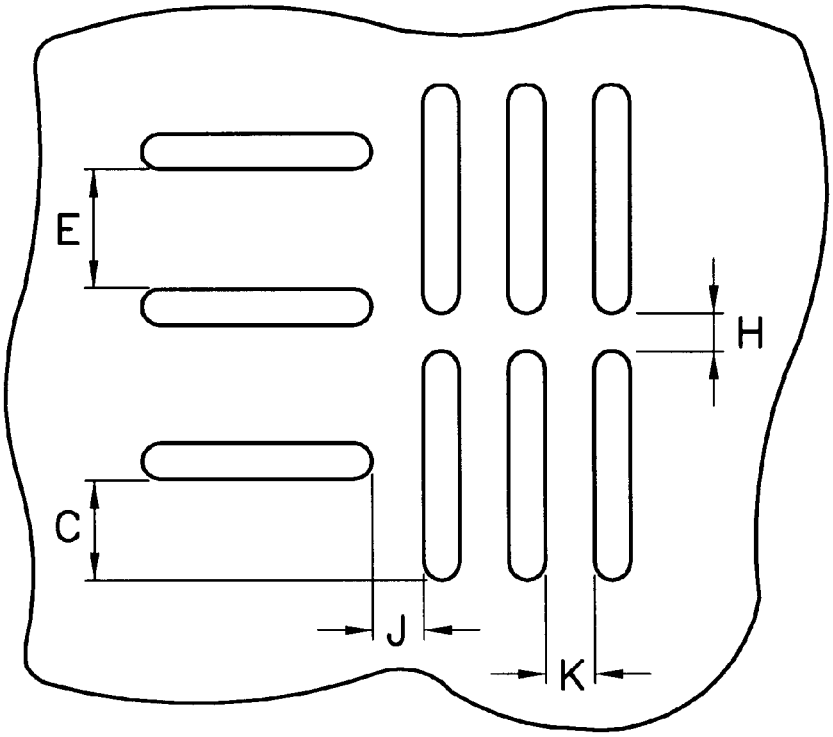
FIG. 10 is a detailed plan view of the spacing of part of the arrangement of ports on the inlet plate of FIG. 8.

FIG. 10 shows slot and inter-port spacing dimensions adopted in the embodiment depicted in FIG. 8. The dimensions of the ports are the same and have a length L of 6 mm and a width W of 0.5 mm. The ends of each slot are semicircular but more squarely ended slots are suitable. In fact, squarer ended slots appear to promote higher flame lift which tends to keep the plate desirably cooler. The chosen manufacturing process can influence the actual plan view shape of the slot. Metal blanking such large numbers of holes can be difficult as regards maintaining such small punches if the corner radii are not well rounded. The photochemical machining process of manufacture of air inlets 79 with slots 104 is also more adapted to maintaining round cornered slots.

The interport spacing illustrated in FIG. 10 performs the required confinement function in the previously described situation. The dimensions indicated in FIG. 10 are as follows: C=4.5 mm; E=3.7 mm; J=1.85 mm; K=1.6 mm; M=1.4 mm; P=3.7 mm.

Figure 11:
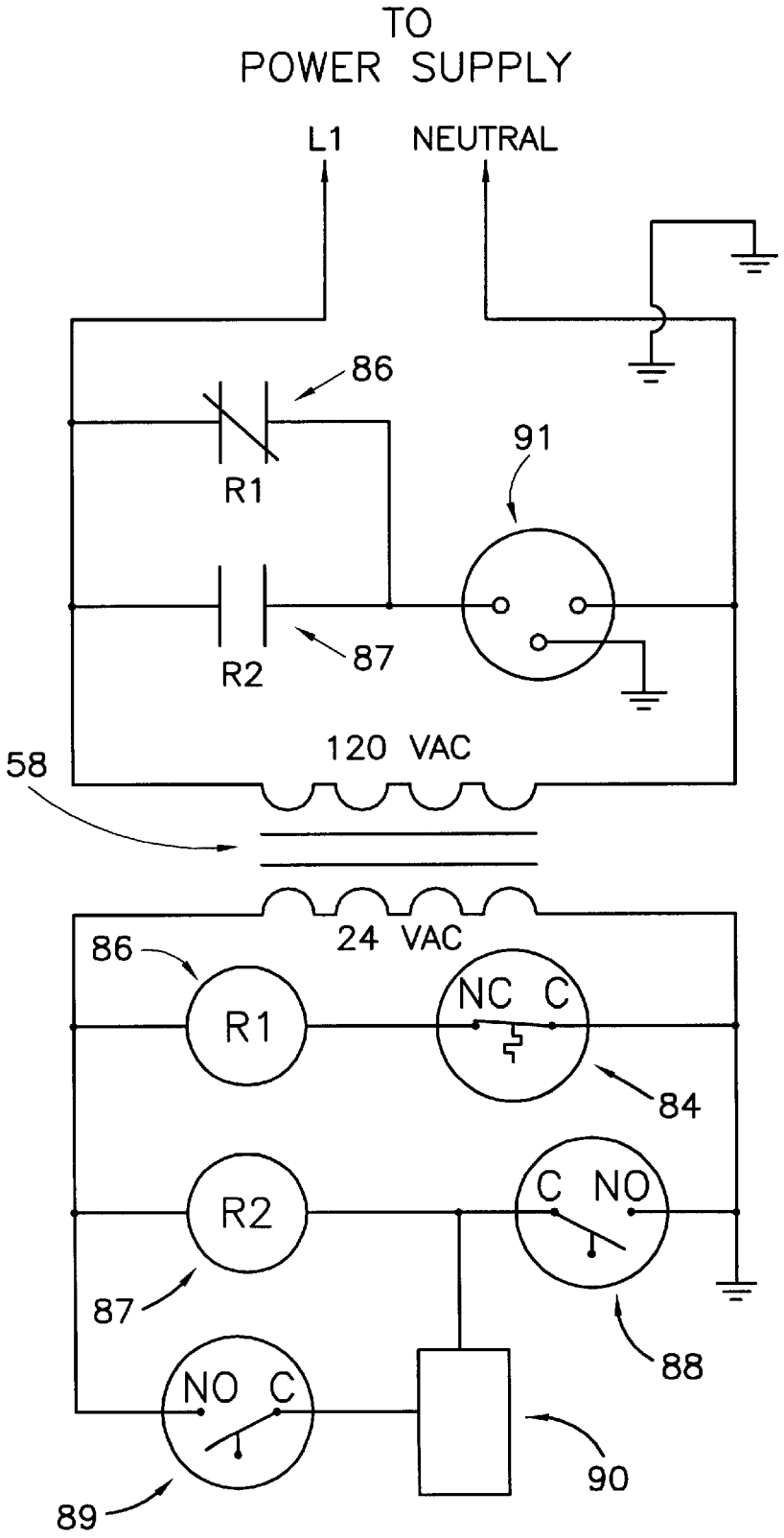
FIG. 11 is an electrical schematic of an embodiment of an electromechanical control system of a water heater incorporating a sensor positioned to detect excess combustion in the combustion chamber in accordance with aspects of the invention.

FIG. 11 illustrates one embodiment of a control system utilizing an electro-mechanical temperature sensor 84 such as that shown in FIG. 7. Temperature sensor 84 is connected to a bypass relay 86 and to gas pressure switch 88. Gas pressure switch 88 is connected to blower relay 87, air pressure switch 89, and solenoid 90 for the operation of blower 91 as previously described herein.

When temperature sensor 84 is activated by heat generated when flammable vapors are burning on inlet 79, temperature sensor 84 (in this case a bimetallic switch) activates bypass relay 86. Bypass relay 86 in turn bypasses blower relay 87 and activates electric motor 52. Electric motor 52 may remain activated until the sensor is manually reset.

In another embodiment of a control system, electronic control circuitry is used to operate electric motor 52. The control circuitry may include, for example, a microprocessor. The microprocessor 92 may be one of many such processors (well known to those of skill in the art), incorporating a central processing unit (CPU), dynamic memory, such as random access memory (RAM), and static memory for storing the program for operating the CPU, such as a programmable read only memory (PROM), or equivalent. Of course, discrete logic chips may also be used in lieu of an integrated microprocessor.

When heat is generated by flammable vapors burning on air inlet 79, microprocessor 72 detects the change at temperature sensor 84 and activates electric motor 52 through blower relay 87. This causes an inflow of dilution air through air inlet 79, thereby avoiding an excessive heat accumulation that might damage the exhaust system. Use of electronic circuitry in this manner provides the significant additional advantage that more operations may be incorporated into the programming of the microprocessor by adding minimal further conventional circuitry. Such operations include, for example, the detection of hot surfaces or spark ignition.

During normal operation, water heater 10 operates in substantially the same fashion as a conventional power vented water heater except that all air for combustion enters through air inlet 79. However, if spilled fuel or other flammable fluid is in the vicinity of water heater 12 then some extraneous fumes from the spilled substance may be drawn through air inlet 79 by virtue of the negative pressure draft characteristics caused by blower 54 of such water heaters. Air inlet 79 allows the combustible extraneous fumes and air to enter but confines potential ignition and combustion inside the combustion chamber 20.

The spilled substance is burned within combustion chamber 20 and exhausted through flue 14 via blower assembly 50 and piping. Because flame is confined by the air inlet 79 within the combustion chamber, flammable substance(s) external to water heater 10 will not be ignited. Moreover, switch 84 will detect the presence of heat generated by such combustion and will cause blower assembly 50 to activate and remove the combustion products by negative pressure. This will avoid overheating of the exhaust system.

Although this invention has been described in connection with specific forms thereof, it will be appreciated that a wide variety of equivalents may be substituted for the specific elements described herein without departing from the spirit and scope of this invention as described in the appended claims. For example, water tank 12 may be of any number of sizes and may be made from a wide variety of materials such as metals and/or plastics. Foam insulation 44 may similarly be made from any number of foam insulations well known in the art. Top pan 46, jacket 32 and bottom pan 24 may be made from coated steel, plastics or the like. Burner 26 may be operated from a wide variety of fuels including natural gas, propane, liquified natural gas, oil and the like. Different sizes and shapes of electric motor 52 may be employed depending on the size and configuration of the water heater.

What is claimed is:

1. A water heater comprising:

a water container;

a combustion chamber adjacent said water container;

a burner associated with said combustion chamber;

a flue connected to said combustion chamber;

a blower assembly positioned to receive combustion products from said flue and including a blower;

at least one inlet having a plurality of ports which permit air and extraneous fumes to enter said combustion chamber and prevent combustion of extraneous fumes outside of said combustion chamber;

a temperature sensor positioned adjacent said inlet; and a controller connected to said blower and said temperature sensor, said controller being capable of activating said blower in response to temperature changes detected by said temperature sensor.

2. The water heater defined in claim 1 wherein said controller is a bypass relay.

3. The water heater defined in claim 2 further comprising a fuel valve connected to said controller and adapted to supply fuel to said burner, said controller being capable of producing an output to energize said fuel valve.

4. The water heater defined in claim 1 wherein said controller is a microprocessor.

5. The water heater defined in claim 1 further comprising a water temperature sensor positioned to detect the temperature of water in said water container and connected to said controller.

6. The water heater defined in claim 5 wherein said controller is capable of receiving temperature information from said water temperature sensor, comparing said temperature information with a predetermined temperature and initiating a heating sequence in said water heater.

7. The water heater defined in claim 6 wherein said predetermined temperature is about 90–180° F.

8. The water heater defined in claim 5 wherein said controller is capable of comparing temperature information received from said sensor with an over-temperature setpoint and deenergizing all controller outputs in response thereto.

9. The water heater defined in claim 8 wherein said controller permits reenergization of said controller outputs upon removing power for a predetermined time and subsequently reapplying power.

10. The water heater defined in claim 8 wherein said over-temperature setpoint is less than or equal to about 210° F.

11. The water heater defined in claim 5 wherein said controller is capable of comparing temperature information received from said water temperature sensor with a predetermined temperature indicative of a desired heated water temperature and deenergizing said blower and a fuel valve adapted to supply fuel to said burner in response thereto.

12. The water heater defined in claim 1 wherein said temperature sensor is a thermistor.

13. The water heater defined in claim 1 wherein said temperature sensor is a bimetal switch.

14. The water heater defined in claim 1 further comprising a standing pilot burner positioned adjacent said burner.

15. The water heater defined in claim 1 wherein said temperature sensor is a thermocouple.

16. The water heater defined in claim 1 wherein said controller comprises a microprocessor.

17. A water heater comprising:

a water container;

a combustion chamber adjacent said water container;

a burner associated with said combustion chamber;

a flue connected to said combustion chamber;

a blower assembly positioned to receive combustion products from said flue;

an exhaust line connected to said blower assembly to convey said combustion products away from said blower assembly;

at least one inlet having a plurality of ports which permit air and extraneous fumes to enter said combustion chamber and prevent combustion of extraneous fumes outside of said combustion chamber;

a temperature sensor positioned adjacent said inlet;

a controller connected to said blower and said temperature sensor, said controller being capable of activating said blower in response to temperature changes detected by said temperature sensor; and a pressure switch positioned to detect blockage of said exhaust line and flow of air from said flue prior to initiation of combustion at said burner.

18. The water heater defined in claim 17 wherein said controller connects to said pressure switch and capable of determining the status thereof.

19. The water heater defined in claim 18 wherein said controller is capable of providing an output to control said burner in response to the status of said pressure switch.

20. The water heater defined in claim 15 wherein said controller is capable of producing output to energize a blower in said blower assembly in response to the status of said pressure switch.

21. The water heater defined in claim 18 wherein said controller is capable of monitoring the status of said switch subsequent to energizing said blower.

22. A water heater comprising:

a water container;

a combustion chamber adjacent said water container;

a burner associated with said combustion chamber;

a flue connected to said combustion chamber;

a blower assembly positioned to receive combustion products from said flue and including a blower;

a temperature sensor located proximate to said burner for detecting changes in temperature therein;

a controller connected to said blower and said temperature sensor, said controller being capable of checking the status of said sensor and energizing said blower.

23. The water heater defined in claim 22 wherein said temperature sensor is a bimetallic switch.

24. The water heater defined in claim 22 wherein said temperature sensor is a thermistor.

* * * * *